US005101609A

United States Patent [19]

Cook

[11] Patent Number: 5,101,609

[45] Date of Patent: Apr. 7, 1992

[54] CIGARETTE PACKAGE INSPECTION INDEXING WHEEL

[75] Inventor: John F. Cook, Rochester, N.Y.

[73] Assignee: Eastman Kodak Company, Rochester, N.Y.

[21] Appl. No.: 729,964

[22] Filed: Jul. 15, 1991

[51] Int. Cl.[5] ..... B65B 57/02

[52] U.S. Cl. ..... 53/53; 53/54; 53/498; 73/865.8; 209/535

[58] Field of Search ..... 53/54, 53, 498; 209/535, 536; 73/865.8

[56] References Cited

U.S. PATENT DOCUMENTS

| | | | |
|---|---|---|---|
| 3,517,477 | 6/1970 | Thornton | 53/53 |
| 3,899,863 | 8/1975 | Seragnoli et al. | 53/53 |
| 4,053,056 | 10/1977 | Day | 53/53 X |
| 4,134,502 | 1/1979 | Seragnoli | 53/54 X |
| 4,643,027 | 2/1987 | Deutsch et al. | 53/53 X |
| 4,858,770 | 8/1989 | Gamberini | 53/53 X |

*Primary Examiner*—James F. Coan

*Attorney, Agent, or Firm*—Raymond L. Owens

[57] ABSTRACT

Apparatus for removing cigarette packages from a packaging machine for the purpose of inspection by a Machine Vision System includes an index wheel and machine vision machine for detecting defective packages and returns only good packages to the machine output flow.

1 Claim, 4 Drawing Sheets

CIGARETTE PACKAGE INSPECTION INDEXING WHEEL

FIELD OF THE INVENTION

The present invention relates to a device for removing finished cigarette packages from the output conveyor of an intermittent motion production machine for the purpose of performing additional processes of inspection by a Machine Vision System. If the cigarette packages satisfy the quality checks performed by the Vision System they are returned to the production machine output conveyor from whence they came with the same orientation and sequence. If any cigarette packages fail the quality checks they are automatically ejected from the device and thus prevented from returning to the good product flow.

BACKGROUND OF THE INVENTION

It is well known that modern industry is placing greater emphasis on Quality Control than ever before. In an effort to enhance the on-line quality control capabilities of their production machines, manufacturers are turning more and more to Machine Vision. Unfortunately most established production machines were not designed with Machine Vision in mind, therefore it is not always possible for a video camera to obtain a clear unobstructed view of the product due to mechanical restrictions. Mechanical re-design of the machine would be intricate, costly and not entirely effective.

In a cigarette packaging machine a bundle of twenty cigarettes are first wrapped in a paper jacket, then proceed to an overwrap station where the packages receive an outer jacket of Cellophane which is folded and heat sealed on three sides; the packages then travel only a short distance before they are inserted into cartons.

It is necessary for a Machine Vision System to perform final quality checks on the cigarette packages after they emerge from the heat sealers and before they are inserted into cartons; the following list summarizes the type of defects which are looked for in this area:

Crumpled packages
Missing Cellophane
Imperfect side seals
Open Cellophane end flaps
Wrinkled Cellophane
Missing or misplaced tear tape In prior machines some of the package surfaces which must be viewed by the video cameras in order to detect the above mentioned defects are not clearly visible due to the mechanical obstructions in the packaging machine conveyor path.

FIG. 1 illustrates the output area of a conventional cigarette packaging machine where pairs of cigarette packages 10 having been wrapped in cellophane, emerge from a heat-sealer 12 and move along a first predetermined path 14 into one of eight receptacles 16 in a rotatable turret 18 which is rotated in intermittent increments of 45° by a mechanical indexing mechanism 22, thus sliding the packages over the fixed baseplate 20 and along a second path to a transfer position 28 where they are transferred by a mechanical pusher 30 to a third predetermined path **14*a* from where they are inserted into cartons. Any packages which have been found to be defective by certain up-stream sensors (not shown) will be rejected from the turret at the reject station 24. At this station the fixed base plate 20 has a cut-out which is larger than the packages; this gap is normally bridged by a movable plate 26 which is automatically moved aside when a known defective package is indexed into the reject station 24 allowing the defective package to drop into a defective product container 32**.

SUMMARY OF THE INVENTION

It is therefore an object of this invention to provide a device for removing cigarette packages from the output conveyor of an intermittent motion production machine in order that the video cameras of a Machine Vision System may obtain clear unobstructed images of the areas of interest in a quality control inspection application.

This object is achieved in a cigarette packaging machine wherein finished cigarette packages are advanced along a first predetermined path, inserted into one of many receptacles in a rotatable turret where they are moved along a second path to a transfer position where they are pushed from the turret to a third predetermined path, the improvement comprising:

(a) a rotatable indexing wheel having spaced cigarette package receiving pockets, the pockets being moved into alignment with a given position of the second path between the receiving and the transfer positions;

(b) means for guiding cigarette packages into a predetermined pocket;

(c) means for rotating the indexing wheel so that the packages in the pockets are advanced sequentially to each of two vision inspection stations;

(d) means for restraining the cigarette packages against the effects of centrifugal force while they are being indexed by the wheel;

(e) means for inspecting the cigarette packages at the two vision stations, on at least three package surfaces of each cigarette package, to determine those packages which are defective;

(f) means for removing defective packages from the indexing wheel, to prevent them from re-entering the finished product flow; and (g) means for returning those cigarette packages which have successfully passed inspection, to a turret receptacle at the given position of the second path so that the cigarette packages are in the same orientation and sequence as they were removed from the turret.

The present invention offers the following advantages over the prior art. It enables a Machine Vision System to inspect cigarette packages with a clear unobstructed view of the areas of interest. It is an add-on device which can be implemented with a minimum amount of modification to existing production machines.

FIG. **3*a*** is a view as seen by one of the video cameras; and

Figures 3, 3A:
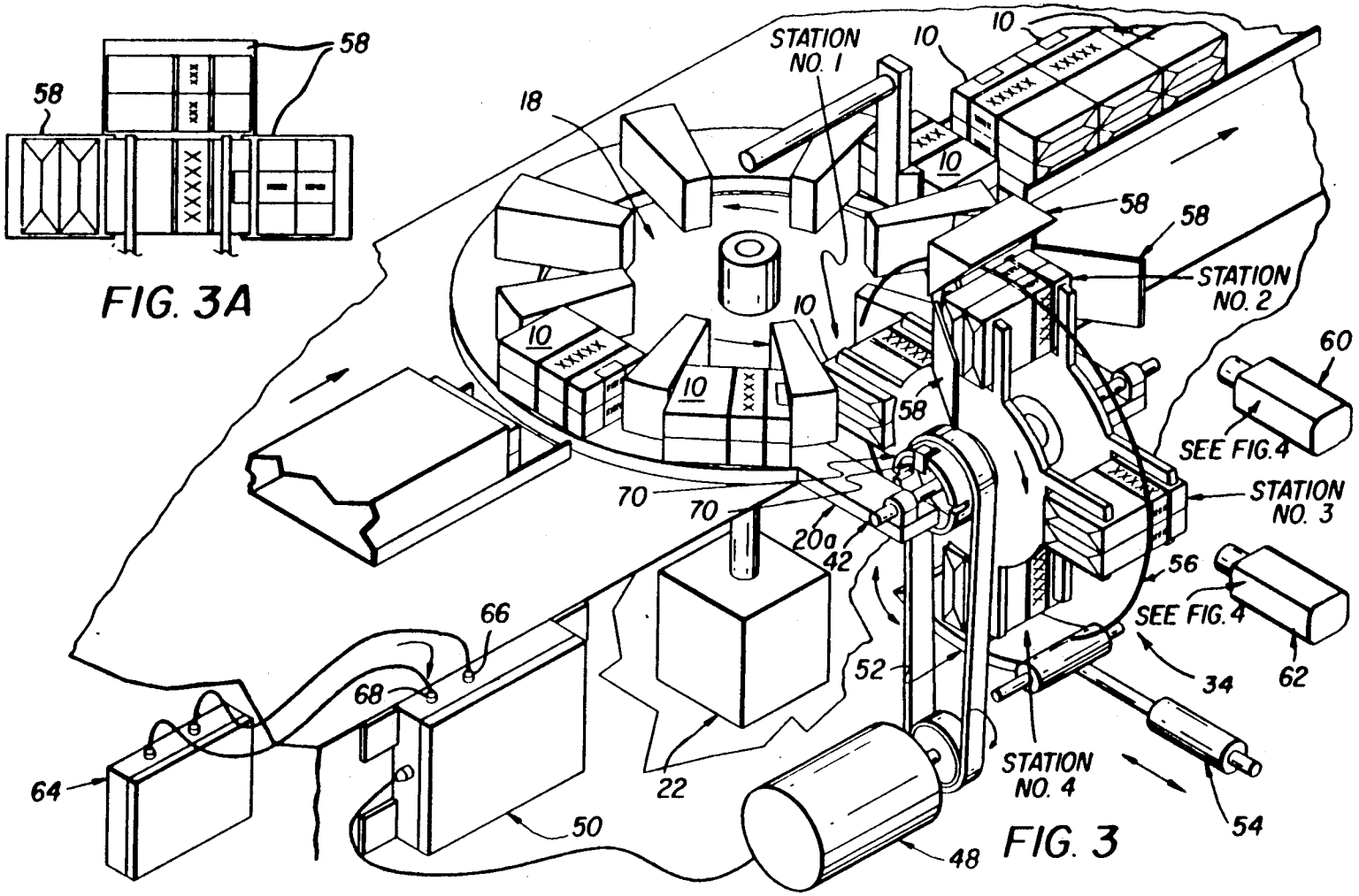
FIG. 3 is a cigarette packaging machine which is a combination of FIG. 1 and FIG. 2 showing the indexing wheel blended into the rotatable turret of the cigarette packaging machine.
Figure 4:
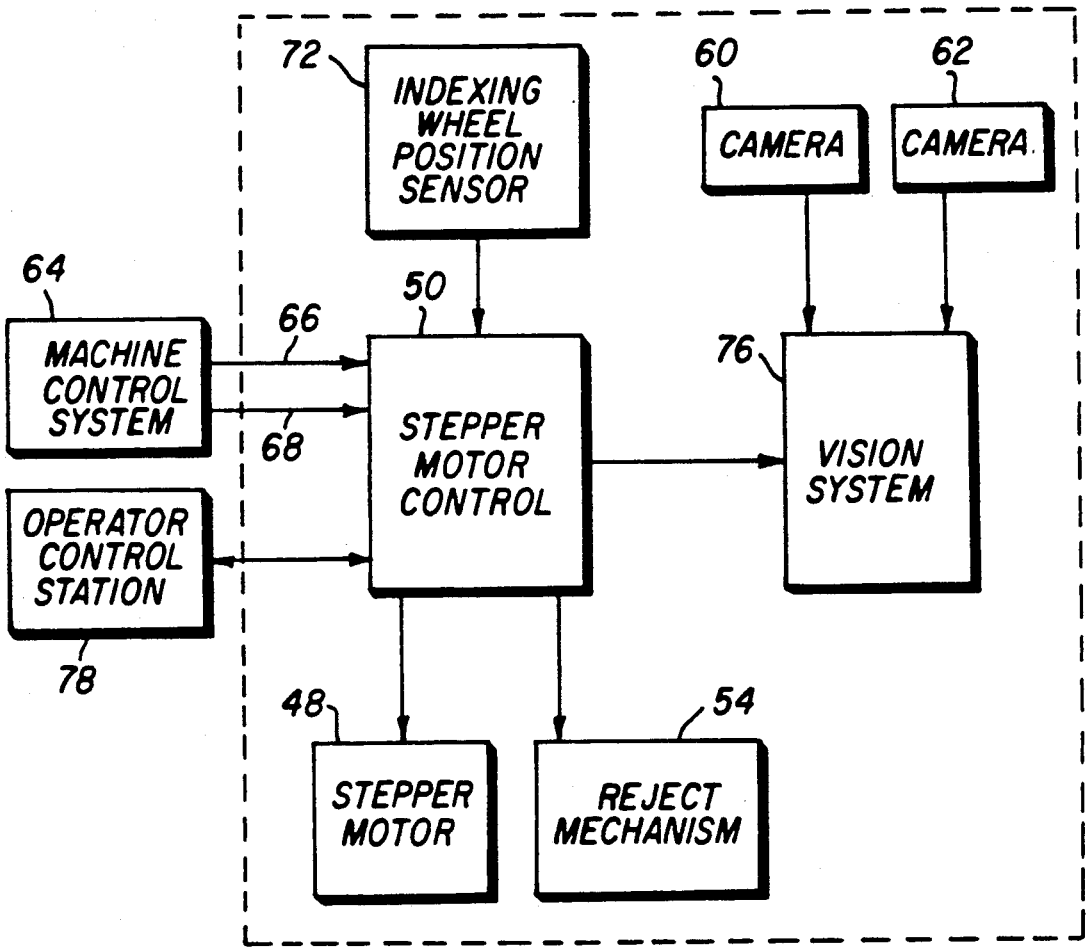

FIG. 4 is a block diagram of the electrical control circuit for controlling the FIG. 3 machine.

Figure 1:
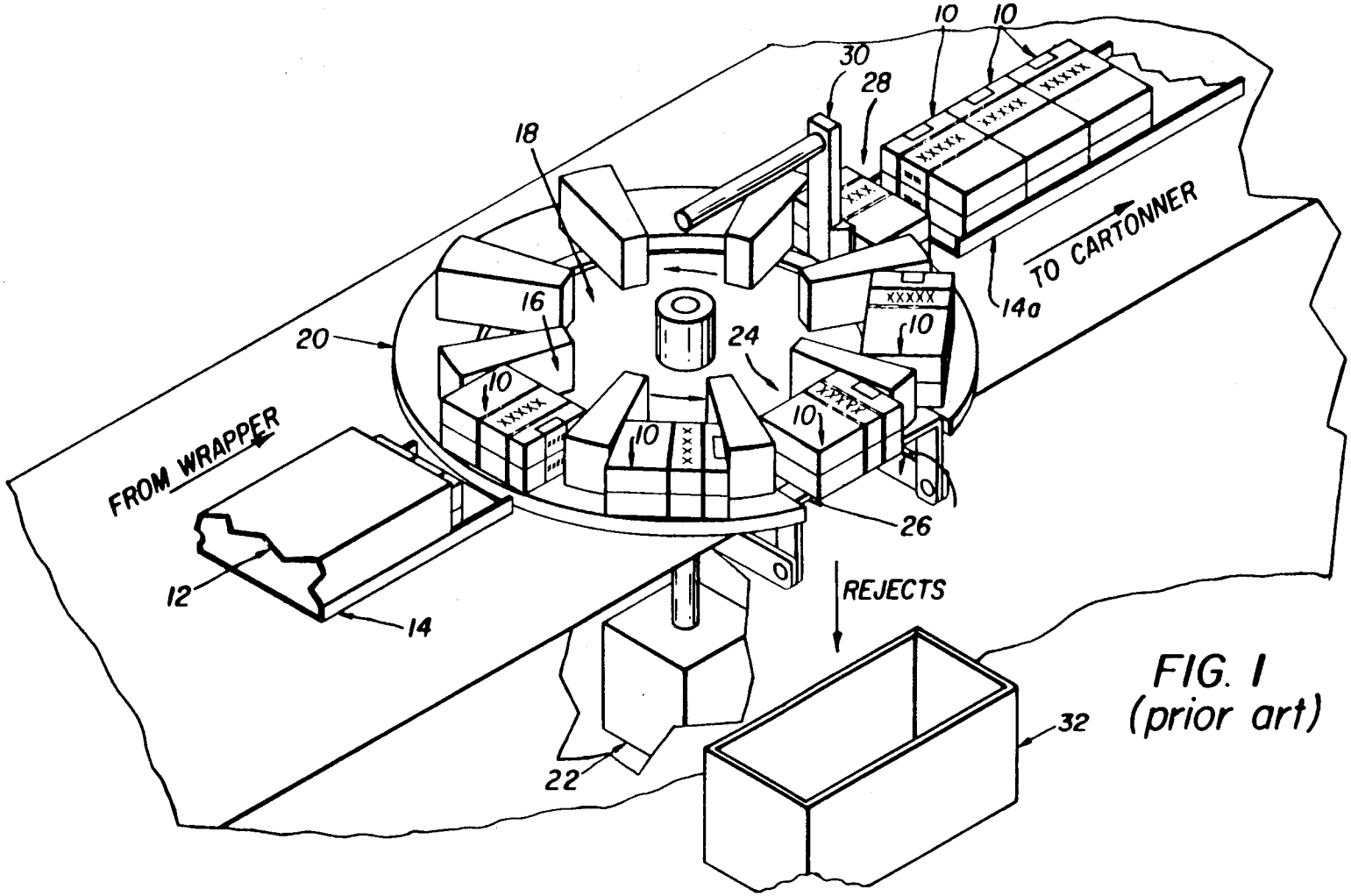
FIG. 1 (prior art)
FIG. 1 is a sketch of the output area of a prior art cigarette packaging machine before the inspection indexing wheel is added.

DESCRIPTION OF THE PREFERRED EMBODIMENT

Where parts correspond to those in FIG. 1, the same reference numerals will be used.

Figure 2:
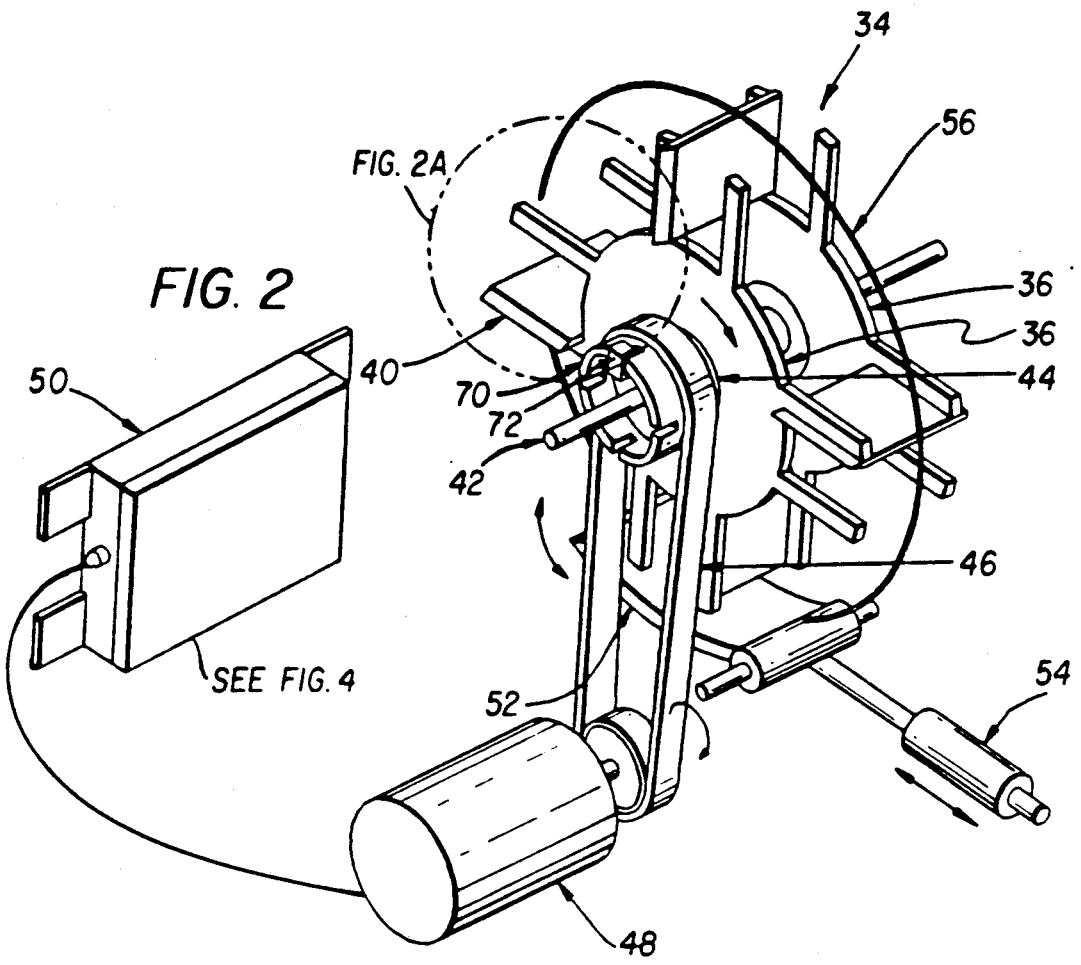
FIGS. 2 and 2A are views of an inspection indexing wheel in accordance with the invention.
Figure 2A:
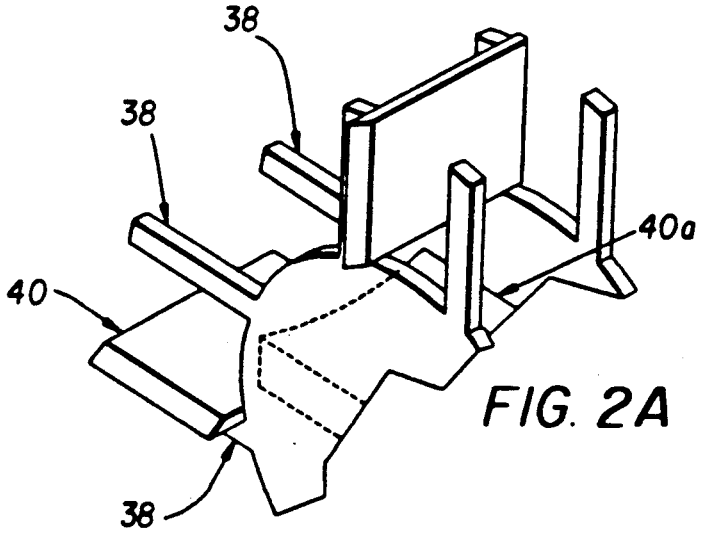

FIG. 2 is a pictorial of an indexing wheel 34 which consists of two identical side plates 36 each having four pairs of fingers 38; the side plates 36 being spaced apart and locked into registration with each other by four guide plates 40 This wheel rotates on ball bearings about a fixed shaft 42. A guide block 40*a* is mounted to the fixed shaft 42 between the side plates 36; this guide block 40*a* has a concave radius which provides a peripheral guide for the cigarette packs 10 (see FIGS. 1 and 3) as they are indexed into the indexing wheel 34 by the rotatable turret 18 (FIG. 1). A pulley 44 mounted on one of the side plates 36 is driven through a timing belt 46 by a stepper motor 48 connected to a programmable stepper motor controller 50. A slotted cylinder 70 is fixed to the pulley 44 and rotates within the slot of a photo-electric sensor 72. The slotted cylinder 70 has four slots spaced at 90° intervals around its circumference.

A wire 56 around the perimeter of the indexing wheel 34 provides a restraint against the effect of centrifugal force on the cigarette packages while they are in motion. Other types of restraining means can be used as will suggest themselves to those skilled in the art. A pivoted reject door 52 operated by a pneumatic cylinder 54 provides a means for removing defective packages from the indexing wheel. Other types of rejecting means can also be used.

Turning back to FIG. 1, the movable plate 26 is removed from the reject station 24 to provide an open area in which the indexing wheel 34 may rotate. The fixed base plate 20 is replaced with one having extended outrigger plates 20*a* (FIG. 3) on which the fixed shaft 42 (FIG. 2) is mounted. The indexing wheel 34 is installed so that the upper surface of each guide plate 40 (FIG. 2) lines up perfectly with the upper surface of the new base plate 20. With the indexing wheel in this position the slotted cylinder 70 is adjusted so that the photoelectric sensor 72 is seeing light through one of the slots.

Turning now to FIG. 3, two electrical signals must be provided by the packaging machine control system 64 to the programmable stepper motor controller 48, these are:

(a) A machine control system 64 produces a synchronization signal over lead 66, which occurs at the precise time that the rotatable turret 18 has completed its index. This signal is derived from a cam operated switch (not shown) on the mechanical indexing mechanism 22.

(b) The machine control system 64 also produces a defective package signal over lead 68; this is the signal which would have initiated the operation of the movable plate 26 at the reject station 24 (FIG. 1) which has now been removed.

The description which follows will refer to Station #1 thru #4; these stations are locations or positions at which each cigarette package receiving pocket will momentarily stop after an index of the indexing wheel 34.

Turning again to FIG. 3 it will be seen that after a pair of cigarette packages 10 are transferred from the second path into the indexing wheel 34 at Station #1, they will sequentially arrive at Stations #2 thru #4. The function of these Stations is as follows:

Station #1. This is the transfer station where all packages 10 enter the indexing wheel 34 and where all those packages 10 which have been judged as "good product" will exit the indexing wheel.

Station #2. This is the first Vision Inspection Station. Here the packages 10 are indexed into an array of three mirrors 58. These mirrors are angled so that the video camera 60 can obtain an image of three sides of the two cigarette packages in addition to the front surface of the front pack as depicted in FIG. 3*a*. The camera view is illuminated by a xenon strobe light (not shown) transmitting through several fiber optic cables (not shown).

Station #3. This is the second Vision Inspection Station where the video camera 62 is checking primarily for the presence and correctness of the "tear tape" which is embedded in the Cellophane wrapper. This "tear tape" can be difficult to discern under normal lighting but will "fluoresce" under ultra-violet light; this is why this second Vision Inspection Station is necessary and an ultra-violet light source (not shown) is provided.

Station #4. this is the Reject Station where all defective packages will be removed from the indexing wheel 34. The judgement that a package is defective will come from one or more of three sources:

1. The Packaging Machine reject shift register which remembers that a particular package failed a check imposed by one of its sensors.
2. The vision inspection performed at Station #2 of the indexing wheel 34.
3. The vision inspection performed at Station #3 of the indexing wheel 34.

Information from the above three sources is inserted into the appropriate cell in a shift register (now shown) which is programmed within the stepper motor controller 48 and the defective packages are tracked as they are indexed around the indexing wheel 34. During the index motion of defective packages between Station #3 and Station #4 the stepper motor controller 50 issues an electrical signal to an air solenoid valve (not shown) which permits compressed air to retract the piston of air cylinder 54 causing the reject door 54 to hinge open. In order to assist ejection at the same time another air solenoid valve (now shown) can be energized and compressed air is directed through the center of the fixed shaft 42 and thus through air jets (now shown) directed at the packages at Station #4.

Let us now pick a point in time coinciding with the completion of the index of the rotatable turret 18. At this point in time the status of the packages at the four stations of the inspection indexing wheel are as follows:

Station #1. This pair of packages have just been loaded into the indexing wheel and have as yet received no Vision inspection process.

Station #2. This pair of packages have received the Vision inspection process associated with Station #2.

Station #3. This pair of packages have received the Vision inspection processes associated with both Station #2 and Station #3.

Station #4. A pair of packages present at this station at this point in time must have satisfied the Vision inspection criteria associated with both Station #2 and Station #3 and had not been previously tagged as defective product when it entered the indexing wheel; this pair of packages will be returned to the rotatable turret 16 from whence it came.

At the instant the index of the rotatable turret 18 is completed the cigarette packaging machine control system 64 sends a synchronization signal 66 to the stepper motor controller 50 which issues a sufficient number of electrical impulses to the stepper motor 48 to drive the indexing wheel through an angle of 90° thus advancing each pair of packages to the next station. At the completion of this 90° index the stepper motor controller 50 issues an electrical signal to the Machine Vision System to initiate the Vision inspection processes at Stations #2 and #3.

The "good" pair of packages which were previously at Station #4 are now back at Station #1 in a turret receptacle 16 (FIG. 1) in the same sequence and orientation as before and waiting for the next index of the rotatable turret 18 at which time they will be moved out and replaced by another pair of cigarette packages 10.

In FIG. 4 the electrical control circuit is shown in detail. The synchronization signal over 66 (FIG. 3) issued by the machine control system 64 causes the stepper motor controller 50 to transmit a fixed number of electrical pulses to the stepper motor 48 which will rotate the indexing wheel 34 (FIG. 3) through an angle of exactly 90°. As the last electrical pulse is sent to the stepper motor 48 the stepper motor controller 50 expects to receive a signal from the indexing wheel position sensor 72 confirming that the indexing wheel 34 (FIG. 3) completed the 90° index, if this signal is absent a jam has occurred and the indexing wheel 34 (FIG. 3) has failed to follow the stepper motor 48 through a full 90° index When a jam is detected the stepper motor controller 50 shuts off the holding current to the stepper motor 48 and energizes an indicator light at the operator control station 78; the indexing wheel 34 (FIG. 3) is now free to be turned manually by the operator in order to clear out the jam. When the jam is cleared the operator presses a push-button switch at the operator control station 78 at which time the stepper motor controller 50 sends electrical pulses to the stepper motor 48 causing the indexing wheel 34 (FIG. 3) to rotate slowly until a signal is received from the indexing wheel position sensor 72 indicating that the indexing wheel 34 has reached its home position at which time the stepper motor 48 will be stopped instantly.

When the indexing wheel 34 stops at the completion of a normal 90° index the stepper motor controller 50 issues a command to the vision system 76 which then captures images from both video cameras 60 and 62. If a defect is found in either of these two images the vision system 76 sends a signal to the appropriate cell of a shift register programmed within the stepper motor controller 50 which will activate the reject mechanism 54 when the known defective package indexes into Station #4 (FIG. 3). If a package has been previously found defection by the prior art machine, the machine control system 64 sends a signal 68 to the stepper motor controller 50 at the time that the defective package enters the indexing wheel 34. This signal 68 is inserted into the shift register programmed within the stepper motor controller 50 and the defective package is rejected at Station #4 regardless of the results of the visual inspection. The machine vision system with cameras 60 and 62 has been briefly described since such systems are commercially available and their operation is well known to those skilled in the art.

The invention has been described in detail with particular reference to a preferred embodiment thereof, but it will be understood that variations and modifications can be effected within the spirit and scope of the invention.

What is claimed is:

1. In a cigarette packaging machine wherein finished cigarette packages are advanced along a first predetermined path, inserted into one of many receptacles in a rotatable turret where they are moved along a second path to a transfer position where they are pushed from the turret to a third predetermined path, the improvement comprising:

(a) a rotatable indexing wheel having spaced cigarette package receiving pockets, the pockets being moved into alignment with a given position of the second path between the receiving and the transfer positions;

(b) means for guiding cigarette packages into a predetermined pocket;

(c) means for rotating the indexing wheel so that the packages in the pockets are advanced sequentially to each of two vision inspection stations;

(d) means for restraining the cigarette packages against the effects of centrifugal force while they are being indexed by the wheel;

(e) means for inspecting the cigarette packages at the two vision stations, on at least three package surfaces of each cigarette package, to determine those packages which are defective;

(f) means for removing defective packages from the indexing wheel, to prevent them from re-entering the finished product flow; and (g) means for returning those cigarette packages which have successfully passed inspection, to a turret receptacle at the given position of the second path so that the cigarette packages are in the same orientation and sequence as they were removed from the turret.

* * * * *